US005404655A

United States Patent [19]

Godderidge et al.

[11] Patent Number: 5,404,655

[45] Date of Patent: Apr. 11, 1995

[54] METHOD AND APPARATUS FOR REGULATING THE SAND DISCHARGE DURING THE THERMAL REGENERATION OF USED FOUNDRY SAND IN FLUIDIZED BED KILNS

[75] Inventors: Volker Godderidge, Irdning, Austria; Walter Stuzmann, Meerbusch, Germany

[73] Assignee: KGT Giessereitechnik GmbH, Dusseldorf, Germany

[21] Appl. No.: 60,255

[22] Filed: May 12, 1993

[30] Foreign Application Priority Data

May 14, 1992 [DE] Germany ..... 42 15 867.2

[51] Int. Cl.[6] ..... F26B 3/08

[52] U.S. Cl. ..... 34/367; 34/580

[58] Field of Search ..... 34/57 R, 57 A, 57 B, 34/10, 359, 360, 367, 576, 580; 432/58

[56] References Cited

U.S. PATENT DOCUMENTS 4,821,654 4/1989 Becker et al. .

5,090,134 2/1992 Russemeyer et al. ..... 34/57 R

*Primary Examiner*—Henry A. Bennet

*Attorney, Agent, or Firm*—Barnes & Thornburg

[57] ABSTRACT

The invention relates to a method for regulating the sand discharge by means of a discharge pipe located on the opposite side of a sand charging means of a fluidized bed kiln in connection with the thermal regeneration of old foundry sand, in which the base of the fluidized bed kiln has openings through which the hot gases pass into the fluidized bed. The method is characterized in that the sand exit from the discharge pipe (4) is freed by increasing the air supply in a pneumatic conveyor (5) following the fluidized bed kiln (1) through its perforated base (7) in such a way that the pouring cone (6) formed between the end of the discharge pipe (4) and the base (7) is decreased and consequently the exit of the discharge pipe (4) is freed.

22 Claims, 3 Drawing Sheets

Figure 1:
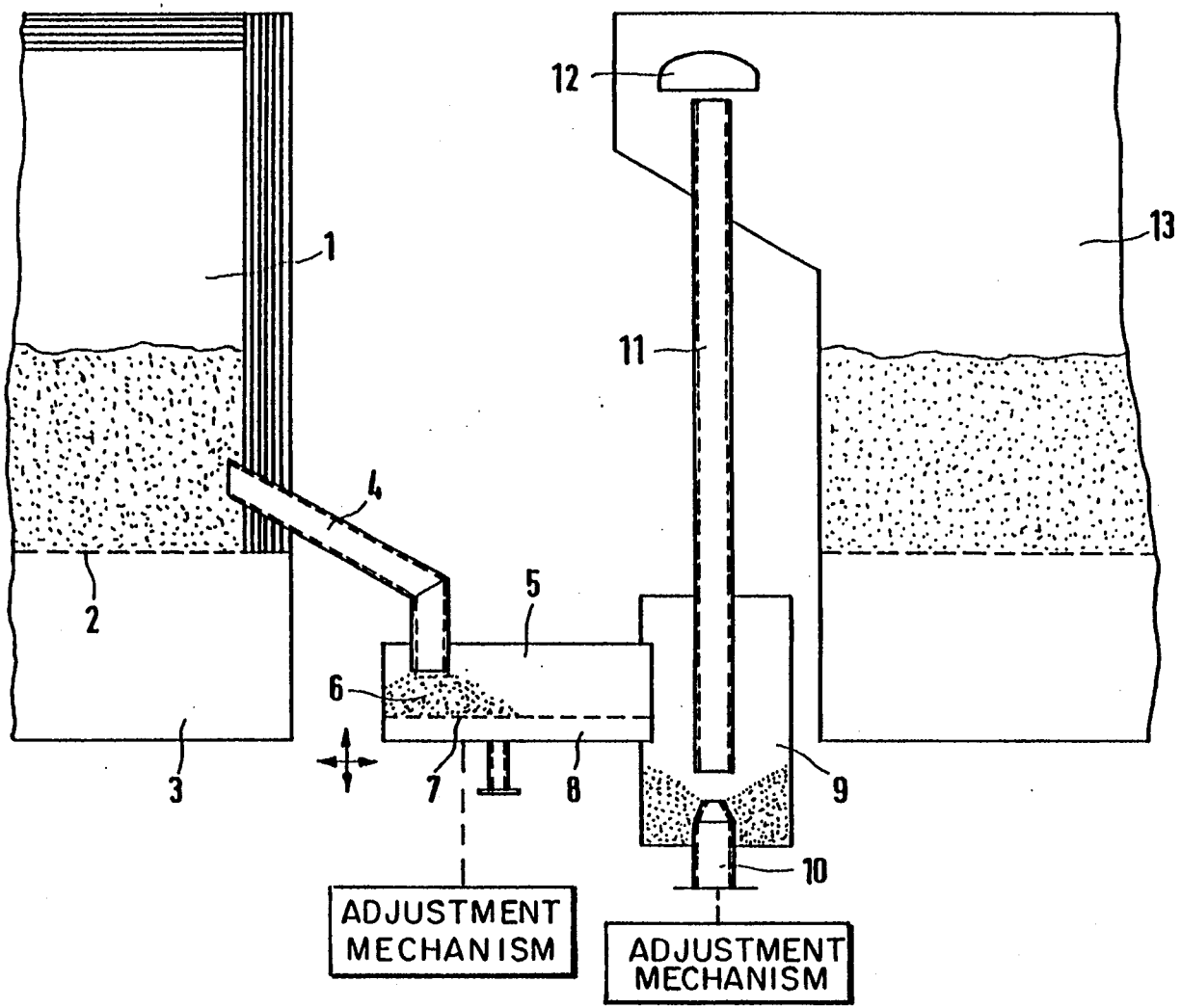

METHOD AND APPARATUS FOR REGULATING THE SAND DISCHARGE DURING THE THERMAL REGENERATION OF USED FOUNDRY SAND IN FLUIDIZED BED KILNS

The invention relates to a method and an apparatus for regulating the sand discharge from fluidized bed kilns, in which the used foundry sand to be generated is charged on one side of the fluidized bed kiln and, following fluid bed-like flow, is discharged on the other side.

DE-OS 3,636,479 discloses a method and an apparatus for the thermo-mechanical regeneration of bulk materials, particularly used foundry sand. In this case preheated used foundry sand is charged on one kiln side. The bottom of the kiln is provided with openings in the form of nozzles through which the combustible gases and combustion air pass into the upper kiln area, so that a fluidized bed is formed and the material to be regenerated is passed in fluid bed-like manner to the sand discharge, which faces the charging means. The regulation of the thermal regeneration process is brought about by a dosing mechanism at the sand charging location and by a retaining web, which is just upstream of the sand discharge. The retaining web serves to stabilize the layer height of the fluidized bed and is provided on its underside with recesses for the passage of non-fluidizable material such as e.g. cast metal splashes, ceramic particles, etc., so that it is impossible for these foreign bodies to clog the hearth. The processes in the fluidized bed kiln can only be brought about by influencing the temperature and modifying the flow rate of the gas flowing through the porous bottom. However, the latter possibilities have an unfavourable influence on a continuous process control and there can only be an air velocity rise within very narrow limits, because immediately there are significant effects on the fluidized bed. With such restricted possibilities it may occur that considerable differences as regards quality are encountered in the thermal regeneration results.

A further disadvantage is that the thermally treated used foundry sand removed from the fluidized bed kiln is always fed into a cooler or some similar device located below the kiln. As a result complicated constructions are required in order to keep the kiln and also the charging mechanism, which are frequently operated by using gravity and without any additional conveying means, above the following devices, so that apart from a very considerable, necessary building height, there are correspondingly high costs for support structures.

The problem of the invention is therefore to regulate in a simple, inexpensive manner the sand discharge from an apparatus for the thermal regeneration of used foundry sand and to keep constant the quality of the regenerated sand, whilst offering the possibility of performing the aftertreatment of the annealed regeneration product at approximately the same height level at which the kiln is located.

According to the invention this problem is solved by the features given in the characterizing parts of claims 1 and 7. Advantageously the method and apparatus according to the invention are further developed by the features of the subclaims.

The sand discharge from the fluidized bed kiln can be regulated simply and at minimum cost by means of the pouring cone acting as an outlet control member and which is formed by the discharged, thermally treated sand on a perforated base of a pneumatic conveyor and which is able in the case of a continuous or unperforated construction to completely close off the exit of sand from the discharge pipe of the fluidized bed kiln. The pouring cone is influenced in that the air supply is regulated by the perforated base of the pneumatic conveyor. This can take place in simple manner by connecting in and out the air flow or by regulating the volume flow, which is passed through the openings. As a result of the air supply annealed sand is moved from the pouring cone in the direction of a pneumatic conveyor trough and from there can be supplied to a further treatment process. At the time when the pouring cone is reduced, the sand exit of the discharge pipe is freed and further completely annealed sand can leave the fluidized bed kiln and, with the air supply through the base openings disconnected or reduced, the pouring cone can form again, so that the sand exit is again closed. In the simplest form the control of the air supply through the base of the pneumatic conveyor could take place in cycle time-controlled manner. This leads to the advantage that the sand exit from the fluidized bed kiln is regulated with no additional mechanical closure elements, which would be subject to high reliability requirements in view of the high temperatures prevailing.

With only limited costs it is possible to adjust to a desired amount the fluidized bed height in the kiln, the sand passing in fluid bed-like manner through the latter, in that the pressure below the fluidized bed in the air chamber of the kiln is measured and used as a control signal for regulating the air supply, which flows through the base of the pneumatic conveyor and influences the pouring cone. The pressure measured in the air chamber is proportional to the fluidized bed height, so that the latter can be kept constant with the indicated means.

The valve regulating the air supply to the pneumatic conveyor can be directly regulated by means of a bypass line, which is connected to the air chamber, using flaps or membranes and requiring no additional control elements. It is also possible to place pressure sensors in the air chamber, which direct the control signals to a control unit. The control unit regulates the air supply valve in accordance with the pressure prevailing in the air chamber. Additionally, it is also possible to measure the temperature in the fluidized bed by means of heat sensors and use same together with the pressure values or alone for regulating the air supply and therefore the exit of sand from the fluidized bed kiln.

The discharge pipe for the completely annealed old foundry sand can be relatively short and have a relatively limited angle of inclination, so that the sand exit is only just below the plane of the fluidized bed formed and consequently a limited overall height is required.

Another possibility for regulating the sand discharge can be achieved in that the pneumatic conveyor is positionally displaceable as regards height and also in the horizontal direction relative to the discharge pipe sand exit, so that the configuration of the pouring cone formed and consequently once again the control sensitivity can be varied.

Using the pneumatic conveyor the completely annealed sand can be supplied from the pouring cone almost on the same plane to further treatment processes. A first cooling of the still hot sand is provided by the air supply. The sand leaves the pneumatic conveyor by means of a conveyor trough and is collected in a blast chamber and from there the air flow passing out of a blast nozzle is drawn into a blast pipe and supplied to a cooler, which is preferably in the form of a fluidized bed cooler. Above the blast pipe exit can be provided an impact bell, against which the sand is thrown and on which split away still adhering impurities. The use of a fluidized bed cooler is particularly advantageous from the standpoint of desired, limited overall height.

The delivery quantity of the sand to be conveyed from the blast container into the cooler can be regulated by modifying the distance between the blast nozzle and the inlet into the blast pipe, with a constant air flow leaving the blast nozzle.

By means of the invention the fluidized bed kiln and the cooler can be placed in one plane, so that the overall height is reduced, there is no need for a complicated support structure and as a result capital costs are decreased.

The invention is described in greater detail hereinafter relative to non-limitative embodiments and the attached drawings, wherein show:

FIG. 1 a diagrammatic representation of the apparatus according to the invention.

Figure 2:
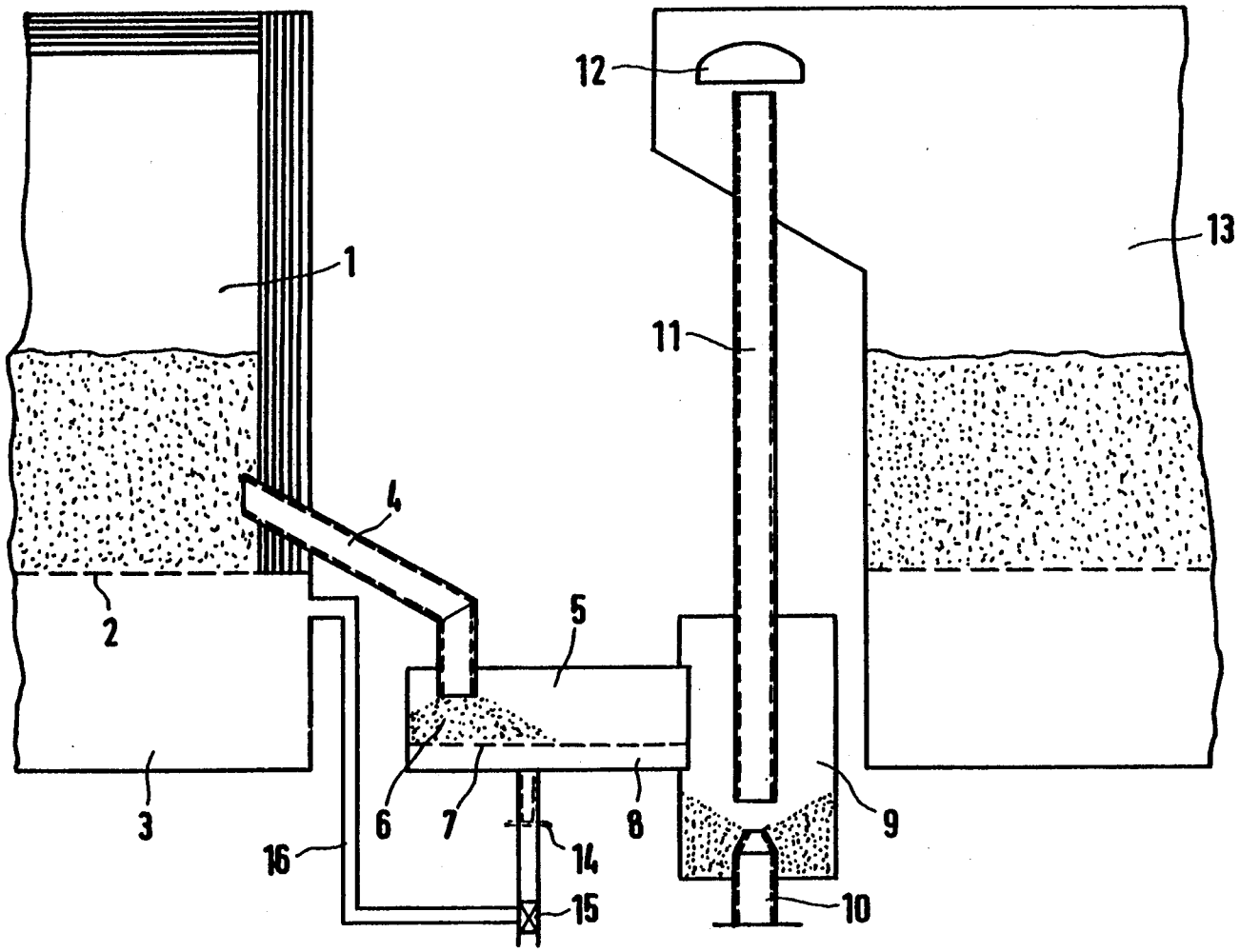

FIG. 2 an improved embodiment of the apparatus.

Figure 3:
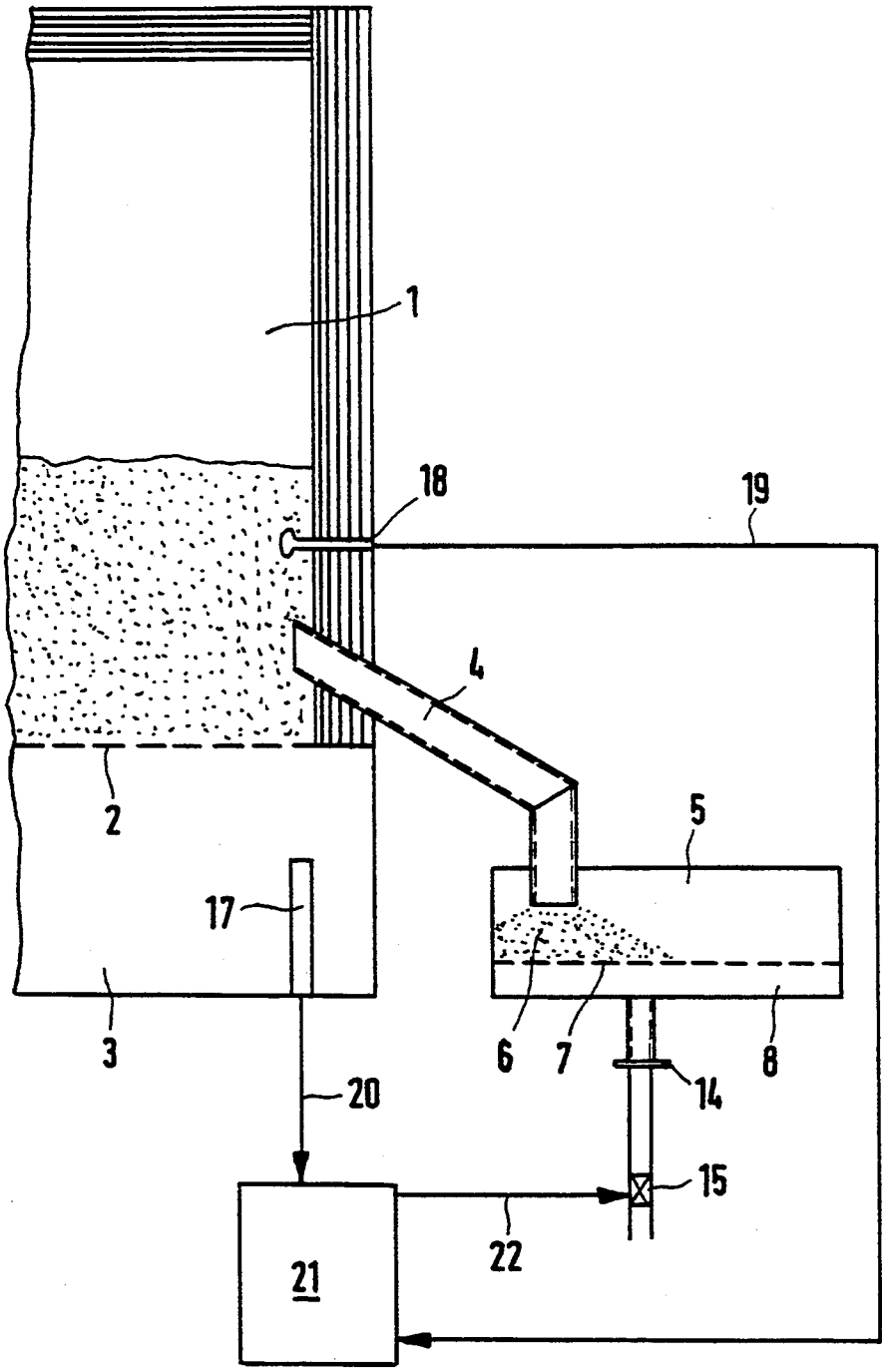

FIG. 3 a regulating device for controlling the sand discharge.

The old foundry sand to be regenerated is heat treated in a fluidized bed kiln 1. The material to be regenerated is supplied by means of a not shown charging mechanism to the fluid bed-like fluidized bed. The fluidized bed is supported on a base 2 provided with openings and is maintained by means of a gas flow consisting of combustible gases and air.

On the side of the fluidized bed kiln 1 facing the charging mechanism is provided a discharge pipe 4 for the discharge of the completely treated old foundry sand. The discharge pipe 4 terminates in a pneumatic conveyor 5 above a base 7, which is also provided with openings, which have a porous or nozzle-like shape. The sand which has flown out of the discharge pipe 4 forms a pouring cone 6 above the base 7 and in the case of an adequate size closes the exit from the discharge pipe 4. The sand exit from the discharge pipe 4 is freed in that an air supply takes place through the openings in the base 7 of the pneumatic conveyor 5 and sand from the pouring cone is supplied by means of the conveyor trough 8 to a subsequent treatment process.

The position of the pneumatic conveyor 5 or its base 7 only is adjustable both vertically and horizontally by means of simple mechanical mechanisms, as are rendered visible in FIG. 1 by the arrow cross. As a function of the setting of the horizontal position and the distance of the sand exit from the discharge pipe 4 from the base 7 of the pneumatic conveyor 5, it is possible to modify the shape of the pouring cone 6. As a function of requirements, this leads to a superior or inferior fine setting of the controllability of the sand exit as a function of the shape of the pouring cone 6.

The sand which is somewhat precooled by means of the air supplied leaves the pneumatic conveyor 5 by means of a conveyor trough 8 and passes into a blast chamber 9 and is conveyed from there into a blast pipe 11 by means of a cold air flow passing out of a blast nozzle 10 and then strikes above the exit from the blast pipe 11 against an impact bell 12 and any still adhering impurities split off. It then passes from the impact bell 12 into a facing fluidized bed cooler 13, where the annealed sand is further cooled and is subsequently supplied to an optional, mechanical regeneration stage or undergoes sifting for removing dust particles.

FIG. 2 shows an additional bypass channel 16, which directly connects the air chamber 3 to the regulating valve 15, which regulates the air supply, which flows through the openings of the base 7, into the pneumatic conveyor 5. The pressure in the air chamber 3 proportional to the fluidized bed height can control the regulating valve 15 in such a way that it merely connects in or out, or in a somewhat more complicated form can bring about a proportional regulation or control. The control of the regulating valve 15 can take place solely with mechanical means, in that the pressure in the bypass channel 16 acts directly on the membranes or flaps, which influence the opening of the regulating valve 15. The regulating valve 15 should be set in such a way that if the air chamber pressure exceeds a desired value, i.e. an upper limit, the air supply is either connected in or increased with the valve 15, so that as a result there is a decrease in the pouring cone 6, which frees the sand exit of the discharge pipe 4. If the air chamber pressure drops to a lower limit, then in reverse manner the air supply is either reduced or disconnected by means of the regulating valve 15 and there is a further build-up of the pouring cone 6 until the sand exit of the discharge pipe 4 is closed.

In an embodiment like that of FIG. 3, besides a pressure sensor 17 in the air chamber a temperature sensor 18 is used in the fluidized bed. Both sensors 17,18 are connected by means of lines 19,20 to a control unit 21. In the control unit 21 there is a comparison of the measured pressures and temperatures with desired value curves and corresponding to the comparison result the regulating valve 15 is controlled by means of the control line 22 and the air supply through the air supply line 14 and the openings in the base 7 of the pneumatic conveyor 5 is regulated for influencing the pouring cone 6.

In simplified form the regulation can be reduced to the evaluation of a single measured signal either of the pressure in the wind chamber or the temperature in the fluidized bed and only one corresponding sensor is fitted in the fluidized bed kiln.

The size of the pneumatic conveyor 5 is largely determined by the volume of the old foundry sand to be regenerated. In the case of larger volume quantities it is also possible to use several discharge pipes 14 with connecting pneumatic conveyors 5 in a parallel arrangement.

The spatial extension of the pneumatic conveyor or conveyors 5 is much smaller than the other elements required for regeneration purposes. Reduced fault proneness results from the simple construction and the associated high level of robustness.

We claim:

1. A method for regulating sand discharge by means of a discharge pipe placed on an opposite side of a fluidized bed kiln from a sand charging means in connection with thermal regeneration of old foundry sand, in which a base of the fluidized bed kiln is provided with openings through which hot gases pass into the fluidized bed kiln, characterized in that by increasing an air supply through a plurality of openings formed in a base of a pneumatic conveyor located adjacent the discharge pipe of the fluidized bed kiln there is a decrease in the size of a pouring cone formed between an outlet end of the discharge pipe and the base of the pneumatic conveyor and the sand exit from the outlet end of the discharge pipe is freed.

2. The method of claim 1, wherein the air supply is regulated as a function of the pressure measured in an air chamber of the fluidized bed kiln in such a way that on exceeding a predetermined, upper limit of the volume flow the air supply is connected in or increased until a lower pressure limit is reached.

3. The method of claim 1, wherein the air supply is regulated as a function of the pressure measured in an air chamber of the fluidized bed kiln and the temperature of the fluidized bed kiln.

4. The method of claim 1, wherein the position of the base of the pneumatic conveyor with respect to the outlet end of the discharge pipe is variable.

5. The method of claim 1, wherein the heat treated old foundry sand is supplied by means of the pneumatic conveyor to a blast container and by means of a blast nozzle and via a blast pipe is thrown against an impact bell.

6. The method of claim 5, wherein the material charge of the feed flow is regulated by modifying the distance between the blast nozzle and the intake of the blast pipe.

7. An apparatus for regulating sand discharge by means of a discharge pipe located adjacent a fluidized bed kiln in connection with thermal regeneration of old foundry sand, in which a base of the fluidized bed kiln has openings through which hot gases pass into the fluidized bed, characterized in that a sand exit from the discharge pipe is located at a distance above a base, provided with openings, of a pneumatic conveyor, which is positioned below the base of the fluidized bed kiln, such that a pouring cone is formed, which can close the sand exit of the discharge pipe and the air flow passed through the base of the pneumatic conveyor can be connected in and out or regulated, and a valve coupled to the air intake of the pneumatic conveyor, the valve being opened or closed as a function of the pressure prevailing in an air chamber of the fluidized bed kiln.

8. The apparatus of claim 7, wherein the valve is connected by means of a bypass line to the air chamber and the pressure in the bypass line directly regulates the degree of opening of the valve.

9. The apparatus of claim 7, wherein the valve is regulatable as a function of the pressure in the air chamber measured with a pressure sensor and/or the temperature in the fluidized bed measured with a temperature sensor.

10. The apparatus of claim 7, wherein the spacing and/or the position between the sand exit of the discharge pipe and the base of the pneumatic conveyor is variable.

11. The apparatus of claim 7, wherein the pneumatic conveyor is connected by means of a conveyor trough to a blast container and the heat treated old foundry sand can be supplied to a fluidized bed cooler through a blast pipe using an air flow from a blast nozzle.

12. The apparatus of claim 11, wherein the spacing between the blast pipe intake and the blast nozzle is variable.

13. The apparatus of claim 11, wherein an impact bell is located above the blast pipe exit.

14. An apparatus for thermal regeneration of old foundry sand, the apparatus comprising:

a fluidized bed kiln having an inlet end for receiving sand from a sand charging means and an outlet end, the fluidized bed kiln including a base formed to include a plurality of openings therein and an air chamber located below the base so that hot gases supplied to the air chamber pass through the plurality of openings formed in the base of the fluidized bed kiln;

a discharge pipe coupled the outlet end of the fluidized bed kiln;

a pneumatic conveyor positioned below the base of the fluidized bed kiln by a predetermined distance, the pneumatic conveyor including a base formed to include a plurality of openings therein and an air chamber located below the base for supplying air through the plurality of openings formed in the base of the pneumatic conveyor; and means for regulating an air supply to the air chamber of the pneumatic conveyor such that a pouring cone of sand is formed between the base of the pneumatic conveyor and an outlet end of the discharge pipe, the pouring cone controlling discharge of sand from the fluidized bed kiln by opening and closing the outlet end of the discharge pipe.

15. The apparatus of claim 14, wherein the regulating means includes a valve which is selectively opened and closed as a function of pressure in the air chamber of the fluidized bed kiln.

16. The apparatus of claim 15, wherein the valve is connected by means of a bypass line to the air chamber of the fluidized bed kiln, the pressure in the bypass line directly regulating the degree of opening of the valve.

17. The apparatus of claim 15, wherein the valve is regulated by a pressure sensor in the fluidized bed kiln.

18. The apparatus of claim 15, wherein the valve is regulated by a temperature sensor in the fluidized bed kiln.

19. The apparatus of claim 14, wherein the position of the outlet end of the discharge pipe relative to the base of the pneumatic conveyor is variable.

20. The apparatus of claim 14, wherein the pneumatic conveyor is connected by means of a conveyor trough to a blast container and the heat treated old foundry sand is supplied to a fluidized bed cooler through a blast pipe using air flow from a blast nozzle.

21. The apparatus of claim 20, wherein the spacing between the blast pipe intake and the blast nozzle is variable.

22. The apparatus of claim 20, wherein an impact bell is located above the blast pipe exit.

* * * * *